United States Patent [19]

Atkin

[11] Patent Number: 4,630,579

[45] Date of Patent: Dec. 23, 1986

[54] INTERNAL COMBUSTION ENGINE

[75] Inventor: Graham E. Atkin, Kennilworth, United Kingdom

[73] Assignee: Austin Rover Group Limited, Coventry, United Kingdom

[21] Appl. No.: 675,878

[22] Filed: Nov. 28, 1984

[30] Foreign Application Priority Data

Dec. 2, 1983 [GB] United Kingdom ..... 8332315
Jul. 31, 1984 [GB] United Kingdom ..... 8419493

[51] Int. Cl.[4] ..... F02F 7/00
[52] U.S. Cl. ..... 123/195 R; 123/195 H
[58] Field of Search ..... 123/195 R, 195 H, 195 MC, 123/195 S

[56] References Cited

U.S. PATENT DOCUMENTS

| | | | |
|---|---|---|---|
| 2,019,558 | 11/1935 | Brush | 123/195 H |
| 2,019,657 | 11/1935 | Church | 123/195 H |
| 2,647,494 | 8/1953 | Ware | 123/195 H |
| 3,046,952 | 7/1962 | Dolza | 123/195 R |
| 3,768,252 | 10/1973 | Kubisch et al. | 123/195 R |
| 4,068,646 | 1/1978 | Hncjsky | 123/195 C |

FOREIGN PATENT DOCUMENTS

| | | | |
|---|---|---|---|
| 65954 | 4/1983 | Japan | 123/195 R |
| 221104 | 9/1924 | United Kingdom | 123/195 H |
| 1229371 | 4/1971 | United Kingdom | 123/195 R |

*Primary Examiner*—Craig R. Feinberg
*Attorney, Agent, or Firm*—Thomas J. Greer, Jr.

[57] ABSTRACT

An internal combustion engine has an integral cylinder block, crankcase and sump structure made in two halves 1, 2. The material of the halves is chosen for lightness. The pressure pulsations in the cylinders are taken by long steel bolts 14, 15 which extend from the top of the cylinder head to a bearing structure comprising yokes (steel clamping members 8, 9 clamped together by traverse fasteners 12, 13) holding together the two main crankshaft bearing housing halves 6, 7 which are formed integrally with each half of the integral engine structure. The integral halves do not have re-entrants and can be produced simply by casting, pressing or moulding.

10 Claims, 6 Drawing Figures

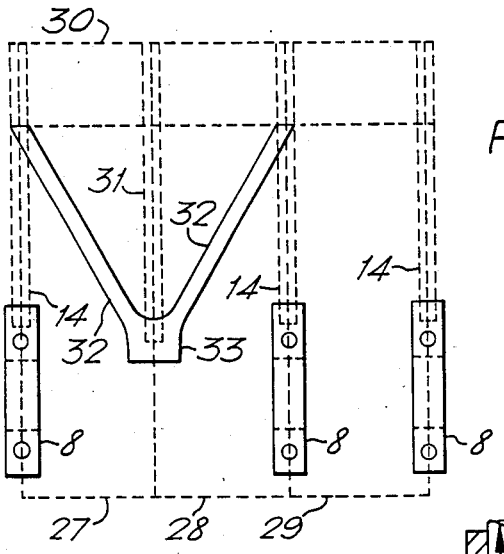
FIG.4.
FIG.6.
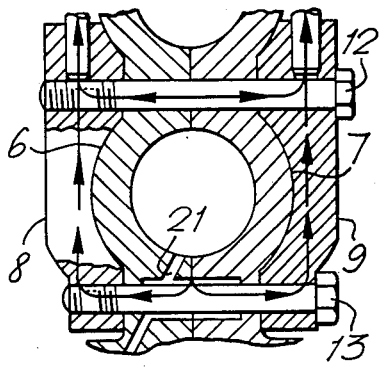
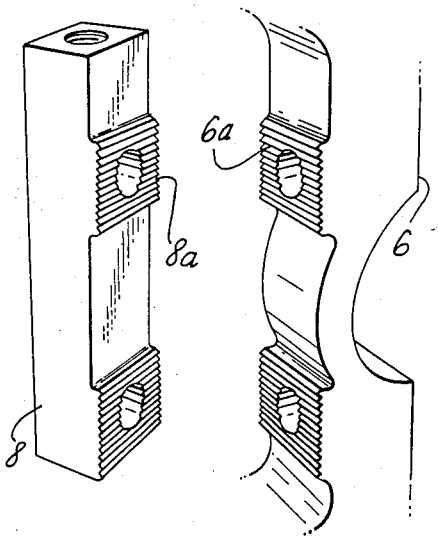
FIG.5.

INTERNAL COMBUSTION ENGINE

This invention relates to internal combustion engines.

In a conventional internal combustion engine, the head is secured to the top of the cylinder block and the crankshaft bearing is secured to the bottom of the block. The pressure pulsations in the cylinders cause high tensile loads to be transmitted through the block. To avoid this, it has been proposed to provide long bolts or studs for securing the head to the block, which long bolts or studs are secured to the crankshaft bearing structures. (U.S. Pat. No. 3,173,407 and French Patent Specification No. 2,022,295). The tensile loads are taken by the long bolts or studs, thereby permitting the use of light low-tensile materials for the block itself.

It has also been proposed (United Kingdom Patent Specification No. 858,593) for the cylinder block and crankcase of an internal combustion engine to be made in two parts split about a plane containing the axes of adjacent cylinders to facilitate manufacture of the parts, for example, by die-casting.

The invention provides an internal combustion engine wherein the housing for each crankshaft bearing is in two halves which meet in a plane containing the axes of the adjacent cylinders, a respective yoke is provided for holding each pair of bearing housing halves together, and tensile members are provided for securing the cylinder head to the cylinder block, which tensile members extend to and are secured to the yokes.

The provision of the yokes for holding the pairs of bearing housing halves together to which the tensile members are secured, enables both the advantages of tensile members to be achieved (use of light low-tensile material for the block possible) and the advantages of a block structure split about a plane containing the axes of adjacent cylinders (ease of manufacture) to be achieved. Thus, the main body of the block can be made of a low-tensile material such as aluminium alloy or a plastics material, since the yokes surrounding the crankshaft bearings and the tensile members themselves will bear the high tensile stresses. Each yoke may include clamping members extending generally in the same direction as the tensile members and transverse fasteners which clamp the clamping members together. The clamping members may be positively located against movement in the direction of the tensile members relative to the crankshaft bearing housing halves. This avoids movement of the clamping members under applied loads in use of the engine and hence avoids the risk of placing the transverse fasteners in shear. The mating surfaces of the crankshaft bearing housing halves and the clamping members may be curved (for example, parallel to the bearing housing surfaces), or mechanical keying such as serrations and preferably in the region of the transverse fasteners may be provided, in order to positively locate the parts against relative movement.

The cylinder block may comprise two parts joined together at the plane, each part being integral with the respective bearing housing half, and the cylinders having liners. The crankcase and/or sump may also be in two parts joined together at the plane, each part being integral with the respective part of the block, providing the possibility of manufacture of each part in a simple manner.

The engine may be spark ignition or compression ignition.

Internal combustion engines constructed in accordance with the invention will now be described, by way of example, with reference to the accompanying drawings, in which:

FIG. 4 is a schematic view of a second engine;

FIG. 5 shows an alternative construction for the tensile members and mating surfaces of the crankshaft bearing housing halves; and FIG. 6 shows another alternative construction for the tensile members and mating surfaces of the crankshaft bearing housing halves.

In a conventional internal combustion engine, a cylinder head is bolted on to the top face of a cylinder block, and the main (crankshaft) bearing caps are bolted to the bottom face. The pressure pulses produced on the firing strokes create a stress path between the cylinder head bolts and the bearing cap bolts, which runs right through the cylinder block. Conventional cylinder blocks are often of cast iron, which is less strong in tension than in compression due to inherent brittleness, or of aluminium alloy which tends to stretch in tension.

Figure 1:
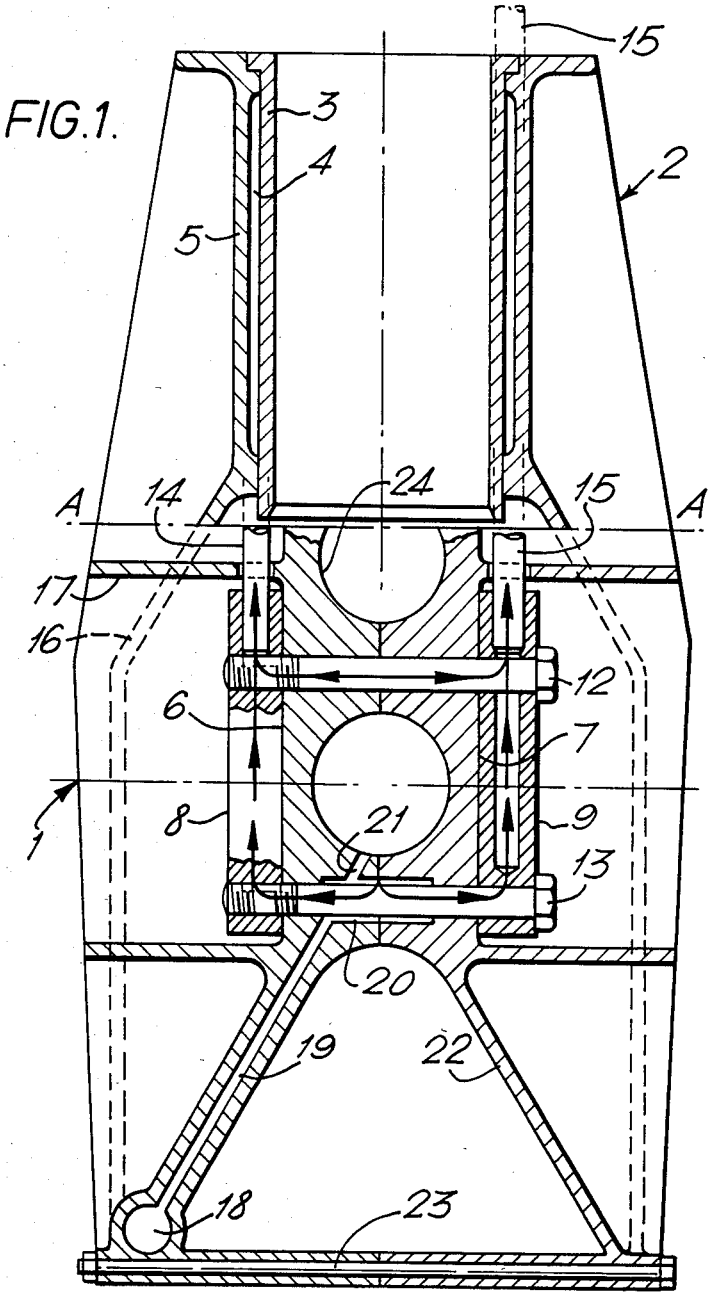
FIG. 1 is a section through the integral block, crankcase and sump structure of a first engine at right angles to the crankshaft axis, the part above line A—A being taken through the axis of a cylinder and the part below line A—A through the crankshaft bearing structure between cylinders.
Figure 2:
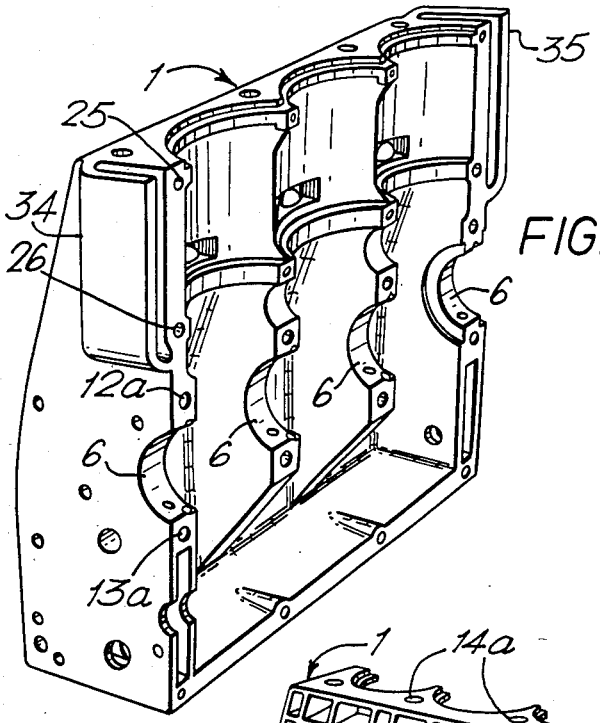
FIG. 2 is perspective view of one half of the integral engine structure showing the interior.
Figure 3:
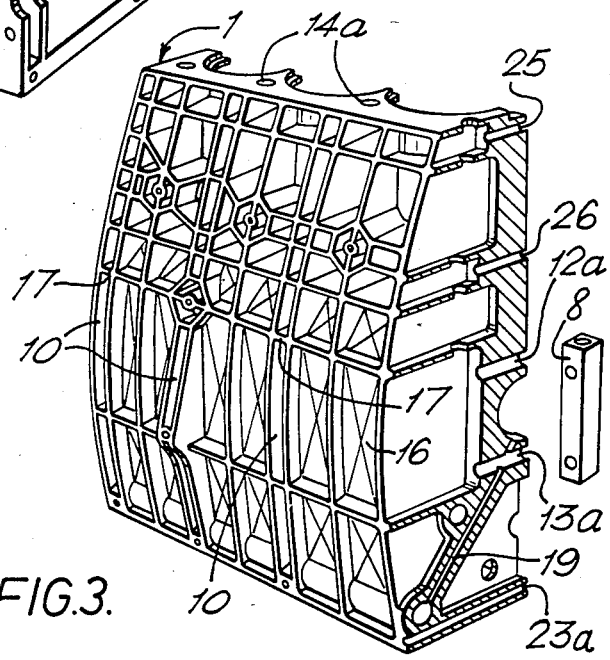
FIG. 3 is a perspective view of the same half of the engine structure, partially cut away, showing the exterior.

Referring to FIGS. 1 to 3, there is shown an integral block crankcase and sump structure for an in-line three cylinder engine. The engine structure is split about a plane containing the cylinder axes into two halves 1, 2. Referring to FIG. 1, the engine has liners 3 which are cooled by means of a water or oil jacket 4 defined by the thin outer wall 5 of the engine. The liners are not shown in FIGS. 2 and 3.

The three throw crankshaft (not shown) is supported by four bearings. Each engine half 1, 2 forms the halves 6, 7 of each bearing housing. Each bearing housing contains two plane bearing shell halves (not shown) which form the bearing for the crankshaft. The bearing housing halves are held together by yokes consisting of steel clamping members 8, 9 which are slotted into apertures 10 in the ribbed exterior of the engine structure and transverse fasteners in the form of steel bolts 12, 13 which pass through the apertures **12*a*, 13*a*, respectively in the engine halves 1, 2 to clamp the clamping members 8, 9 together. The engine halves are also held together by bolt 23 and bolts (not shown) which pass through apertures 25, 26**.

The clamping members 8, 9 are also internally threaded to receive long tensile members in the form of steel bolts 14, 15 which engage the top of the cylinder head (not shown) and extend through apertures **14*a*, 15*a* in the engine halves 1, 2**.

Studs could be used in place of bolts if desired.

The result of this is that stresses due to cylinder pressure pulsations, which appear between the cylinder head and main bearings, are borne by the long steel bolts 14, 15 and the steel yokes 8, 9, 12, 13. The engine structure itself (the two halves) is maintained in substantially compressive loading and does not bear the tensile stresses, and so can be made of thinner and lighter material than hitherto.

The wall 16 of the crankcase is kept to a minimum thickness in the interest of lightness, and a large number of ribs, for example, ribs 17 are formed in the interest of stiffness.

Bearing lubrication is provided by a gallery 18 which feeds oil passage 19 and via chamber 20, passage 21.

Supporting ribs 22, and the rib that houses the oil passage 19 feed residual bottom end loads to the steel tensile member 23, which extends through apertures 23*a*.

Apertures 24 assist in relieving any internal pumping pressures which may build up between one cylinder and another.

Walls 34, 35 (shown only in FIG. 2) define volumes which are U-shaped in plan view and which communicate by means of apertures (not shown) in the crankcase end walls with the volume beneath the pistons. This permits crankcase ventilation (which could be forced ventilation using induction tract depression) between the crankcase and the valve gear cover of the head (not shown) and return of lubricating oil from the valve gear cover to the sump. Alternatively the walls could be omitted and the ventilation and oil return paths could be provided elsewhere.

The engine halves 1, 2 are made of aluminium alloy. Neither of the halves has re-entrants (undercuts) and the halves are made by pressure die-casting. The sand-coring of conventional blocks is eliminated. A wide choice of alternative materials and methods of manufacture is possible. Thus, the engine halves may be of aluminium alloy, sand or gravity die-cast, or of magnesium alloy, sand or die-cast (pressure or gravity die-cast). As an alternative, the engine halves could be of plastics material such as polyester or phenolic material. Thermosetting plastics such as phenolic materials or polyimide (with or without reinforcement) may be used, and may be injection or compression moulded: such material is usually in powdered form in the raw state. As a further alternative, some of the ribs could be omitted and the halves could be made by pressing sheet steel or S.M.C., sheet moulding composition (usually a polyester), or D.M.C., dough moulding composition (also usually a polyester). As a further alternative, traditional materials such as cast iron could be used.

Gallery 18 and apertures 25, 26, 12*a*, 13*a*, 23*a*, 14*a*, 15*a* and 19 may all be formed either by drilling or integrally during the moulding or casting process. Dowels are then inserted into apertures 20 to align the engine halves as they are brought together by rams for certain machining operations. The top of the engine and both ends are faced. The main bearing housings 6, 7, which have been deliberately made slightly too small a diameter, are bored out to the correct diameter. Also a counterbore is made for each liner 3. The engine halves are then separated, the bearing shell halves are inserted, and the cylinder liners 3, the pistons, connecting rods and crankshaft are mounted in one half. R.T.V. rubber (room temperature vulcanising rubber) or a similar sealing compound (for example, an anaerobic compound) is spread on the peripheries of the engine halves, and the parts are bolted together around the yokes. Finally the cylinder head (not shown) can be placed on top of the structure, and the long steel bolts 14 and 15 can be threaded into the apertures in the clamping members 8, 9.

The design is applicable to different numbers of cylinders, and horizontally-opposed rather than in-line engine configurations, or other configurations where cylinders lie in a plane. The invention is applicable to compression ignition engines as well as spark ignition. Also, it is not necessary for the crankcase and sump to be integral with the block: if desired a separate crankcase and sump could be employed.

Referring to FIG. 4, a three cylinder engine is shown schematically. The disposition of the cylinders is shown by the dotted lines 27 to 29. The head is shown in dotted outline 30. The engine is similar to that of FIGS. 1 to 3 (like reference numerals being given to like parts) except in that the bearing of the crankshaft between the first and second cylinders from the left as seen in the drawing is omitted. Consequently the bearing housing halves 6, 7 are omitted, as is the corresponding yoke 8, 9, 12, 13.

In order that the cylinder head attachment bolts between the first and second cylinders do not result in tensile loads being applied to the block to react the impulsive forces being applied to the integral engine structure on the firing strokes, cylinder head attachment bolts 31 between the first and second cylinders are threaded into bosses 33. The bosses 33 are formed integrally with the integral engine structure and with the ribs 32 which abut the cylinder head 30. The ribs 32 are therefore in compressive loading, and impulsive forces on the head are reacted compressively against the head rather than in a tensile manner through the engine structure. Thus, even though one bearing has been omitted, the engine structure is still maintained in substantially compressive not tensile loading, enabling the thinner and lighter structure to be employed. It will be appreciated that the integral ribs 32 and boss 33 are formed in each engine half, and two bolts 31 are used. Different bearings could of course be omitted, and this arrangement could be used with different numbers of cylinders.

Referring to FIG. 5, an alternative construction is shown for the tensile members and mating surfaces of the crankshaft bearing housing halves of the engine of FIGS. 1 to 3 and 4.

Thus, steel clamping member 8 is provided with horizontal serrations 8*a* and main bearing housing half is provided with complementary serrations 6*a*, the serrations 8*a* and 6*a* together forming a mechanical key.

Shear loads between the clamping members 8, 9 and the main bearing housing halves are carried by the mechanical keying. In the arrangements of FIGS. 1 to 3, and FIG. 4, the mating faces of the clamping members 8 and 9 and the main bearing housing halves are smooth, and the clamping load of the steel bolts 12, 13 is relied on to avoid relative movement therebetween. However, with certain materials, for example aluminium, for the block structure, it is possible that brinelling could occur and the aluminium could be squeezed and permanently reduced in thickness in the direction of the bolts 12. 13. Then relative movement could occur and loads through the steel bolts 14, 15 would not be adequately restrained which in turn could cause a risk of the transverse bolts 12, 13 being placed in shear.

Instead of providing serrations in the block, the block may be smooth and the superior hardness of the steel clamping members 8, 9 may be relied upon to impress complementary serrations in the block during or before the assembly process.

The serrations may be horizontal as illustrated, or diagonal, or cross-hatched or herringbone.

An alternative or additional way of positively locating the clamping members against movement in the direction of the tensile members relative to the crankshaft bearing housing halves is shown in FIG. 6. The mating surfaces of the clamping members 8 and the crankshaft bearing housing halves 6 are curved in a direction parallel to the bearing housing surfaces, that is, circularly curved.

What is claimed is:

1. An internal combustion engine comprising a cylinder head, a plurality of cylinders and a cylinder block containing rigidly secured thereto crankshaft bearings, housing for each crankshaft bearing is in two halves which meet in a plane containing the axes of the cylinders which are adjacent to each other, a respective yoke is provided on opposite outer sides of each bearing housing for holding each pair of bearing housing halves together, and tensile members are provided for securing the cylinder head to the cylinder block, which tensile members extend to and are secured to the yokes, wherein each yoke includes clamping members extending in generally in a direction same as the tensile members and fasteners transverse to said clamping members which clamp the clamping members together.

2. An engine as claimed in claim 1, wherein the clamping members are positively located against movement in the direction of the tensile members relative to the crankshaft bearing housing halves.

3. An engine as claimed in claim 2, wherein mating surfaces of the crankshaft bearing housing halves and the clamping members are curved.

4. An engine as claimed in claim 1, wherein there is provided mechanical keying between the crankshaft bearing housing halves and the clamping members.

5. An engine as claimed in claim 4, wherein the mechanical keying is in the region of the transverse fasteners.

6. An engine as claimed in claim 5, wherein the mechanical keying is in the form of serrations.

7. An engine as claimed in claim 1, wherein the cylinder block comprises two parts joined together at the plane, each part being integral with the respective bearing housing half, and the cylinders having liners.

8. An engine as claimed in claim 7, wherein the two parts are free from undercuts so as to facilitate moulding or casting thereof.

9. An engine as claimed in claim 7, wherein the cylinder block and crankcase are integral with each other and comprise two parts joined together at the plane.

10. An engine as claimed in claim 9, wherein the cylinder block, crankcase and sump are integral with each other and comprise two parts joined together at the plane.

* * * * *